US008353299B2

(12) United States Patent
Sherron et al.

(10) Patent No.: US 8,353,299 B2
(45) Date of Patent: Jan. 15, 2013

(54) TOBACCO FLAVOR APPLICATOR

(75) Inventors: James L. Sherron, Midlothian, VA (US); Ashok Kumar, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 1602 days.

(21) Appl. No.: 11/344,984

(22) Filed: Feb. 1, 2006

(65) Prior Publication Data

US 2006/0124143 A1 Jun. 15, 2006

Related U.S. Application Data

(62) Division of application No. 10/371,355, filed on Feb. 20, 2003, now abandoned.

(51) Int. Cl.
*A24B 3/02* (2006.01)

(52) U.S. Cl. ..... 131/306; 131/300; 131/309

(58) Field of Classification Search ..... 131/275, 131/276, 309, 306, 300
See application file for complete search history.

(56) References Cited

U.S. PATENT DOCUMENTS

| | | | | |
|---|---|---|---|---|
| 2,716,996 | A | 9/1955 | Bauerlein | |
| 3,369,551 | A | 2/1968 | Carroll | |
| 4,054,145 | A * | 10/1977 | Berndt et al. | 131/306 |
| 4,306,577 | A | 12/1981 | Wu et al. | |
| 4,379,464 | A | 4/1983 | Wu et al. | |
| RE32,095 | E | 3/1986 | Wu et al. | |
| 4,596,259 | A | 6/1986 | White et al. | |
| 4,700,727 | A | 10/1987 | Torigian | |
| 4,785,833 | A | 11/1988 | Holzner et al. | |
| 4,817,640 | A | 4/1989 | Summers | |
| 4,969,477 | A | 11/1990 | Yagisawa | |
| 5,520,942 | A | 5/1996 | Sauer, Jr. et al. | |
| 5,532,010 | A | 7/1996 | Spanier et al. | |
| 5,688,543 | A | 11/1997 | Freeport et al. | |
| 5,976,603 | A | 11/1999 | Kota et al. | |
| 5,992,421 | A | 11/1999 | Bae | |
| 6,026,829 | A | 2/2000 | Mitha et al. | |
| 6,220,258 | B1 | 4/2001 | Briggs et al. | |
| 6,402,068 | B1 * | 6/2002 | Handleman | 241/39 |
| 6,695,924 | B1 * | 2/2004 | Dube et al. | 131/274 |
| 6,796,704 | B1 * | 9/2004 | Lott | 366/163.2 |
| 2002/0170925 | A1 * | 11/2002 | Friedman | 222/129.1 |

* cited by examiner

*Primary Examiner* — Richard Crispino
*Assistant Examiner* — Dionne Walls Mayes
(74) *Attorney, Agent, or Firm* — Connolly Bove Lodge & Hutz LLP

(57) ABSTRACT

A system of applying liquid flavor to cut tobacco material includes a first tank of concentrated liquid flavor and a second tank of water. A venturi device is constructed and arranged to receive and meter concentrated liquid flavor and water from the first and second tanks and to discharge mixed flavor and water from an outlet end. A first line is connected between the first tank and a suction port on the venturi device, and a second line is connected between the second tank and an intake port on the venturi device. A spray assembly is in fluid communication with the discharge outlet of the venturi device for applying mixed flavor and water to cut tobacco.

3 Claims, 1 Drawing Sheet

TOBACCO FLAVOR APPLICATOR

CROSS-REFERENCE TO RELATED APPLICATION

The present application is a division of application Ser. No. 10/371,355, filed Feb. 20, 2003.

BACKGROUND OF THE INVENTION

The present invention relates to a tobacco flavor applicator that eliminates the need to prepare, store and analyze finished tobacco flavors prior to the application of such flavors onto tobacco. Instead, concentrated flavors are mixed with suitable solvents and diluents at the time of application of the flavors to the tobacco which eliminates waste and increases manufacturing efficiency.

The existing process of applying flavors to tobacco requires equipment, space and personnel. Normally, flavor concentrates are made at a flavor center and delivered to a primary flavor kitchen. The primary kitchen has blending tanks, storage tanks, pumping equipment, measuring devices, bulk stored solvents, and personnel for blending flavors. The flavor concentrates are added to solvents and water in a blend tank. Flavor solubility is important and maintained with the solvents. The finished flavor is analyzed by quality assurance, and the approved finished flavor is stored in tanks until used. The finished flavor is then pumped to a spraying system inside a rotary cylinder, and the remaining finished flavor must be used within a prescribed time or it will become waste.

SUMMARY OF THE INVENTION

The concentrated tobacco flavor applicator of the present invention eliminates the need to prepare, store, and analyze finished tobacco flavors at the primary level, and the use of solvents is greatly reduced. Concentrates made at the flavor center are ready for use with the flavor applicator which eliminates waste and increases manufacturing efficiency.

In accordance with the present invention, a system is provided for applying liquid flavor to cut tobacco material. The system includes a first tank of concentrated liquid flavor and a second tank of a suitable diluent such as water. A venturi device is constructed and arranged to receive and meter concentrated liquid flavor and water from the first and second tanks and to discharge mixed flavor and water from an outlet end. A first line is connected between the first tank of concentrated liquid flavor and a suction port on the venturi device, and a second line is connected between the second tank of water and an intake port on the venturi device. A spray assembly is in fluid communication with the discharge outlet of the venturi device for applying mixed flavor and water to cut tobacco.

The system further includes a tobacco transport such as a belt conveyor or a rotary cylinder adjacent the spray assembly so that the cut tobacco on the tobacco transporter is sprayed with mixed flavor and water as the cut tobacco travels past the spray assembly. The spray assembly may include a spray manifold with a plurality of spray heads connected thereto. Moreover, a first pump and first valve may be included in the first line interconnecting the first tank of concentrated liquid flavor with the venturi device. Also, a second pump and second valve may be included in the second line interconnecting the second tank of water with the venturi device.

The present invention also includes a method of applying liquid flavor to cut tobacco comprising the steps of providing a venturi device having intake, suction and outlet ports. Concentrated liquid flavor is applied to the suction port of the venturi device while water is delivered to the intake port of the venturi device. Mixed flavor and water is discharged from the outlet port of the venturi device, and the mixed flavor and water from the discharge outlet port is sprayed onto cut tobacco. Cut tobacco may be continuously transported for spraying with the mixed flavor and water.

BRIEF DESCRIPTION OF THE DRAWINGS

Novel features and advantages of the present invention in addition to those mentioned above will become apparent to persons of ordinary skill in the art from a reading of the following detailed description wherein similar reference characters refer to similar parts and in which.

DETAIL DESCRIPTION OF THE INVENTION

Figure 1:
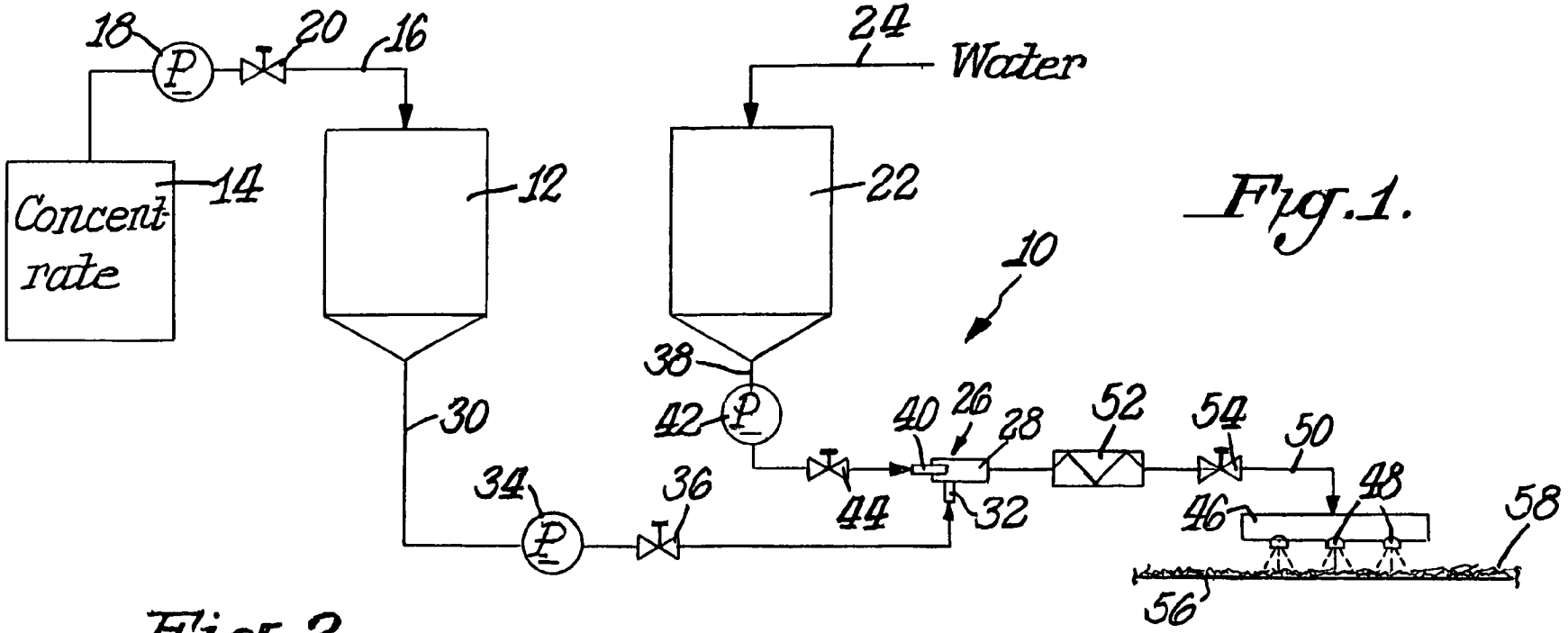
FIG. 1 is a schematic flow diagram illustrating a system for the application of flavor to cut tobacco, according to the present invention.
Figure 2:
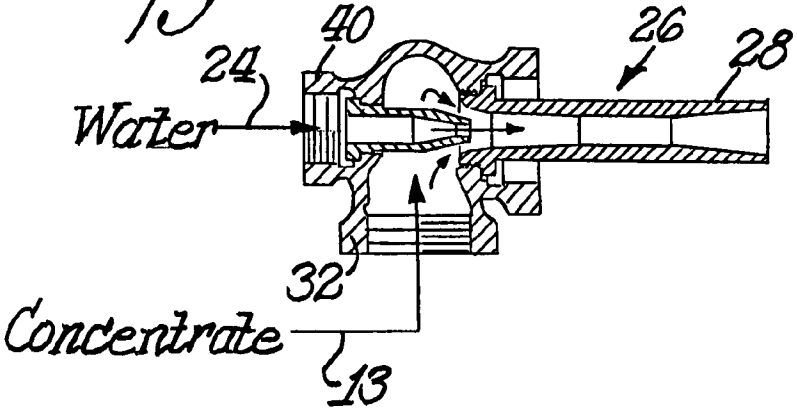
FIG. 2 is a cross-sectional side elevational view of a venturi device of the system shown in FIG. 1.

Referring in more particularity to the drawings, FIG. 1 schematically illustrates a flow diagram of a system 10 for the application of flavor to cut tobacco. System 10 includes a first tank 12 of concentrated liquid flavor 13, and such flavor may be supplied to the tank 12 via a concentrate transfer tank 14 connected to tank 12 by a suitable line 16 that includes a pump 18 and metering valve 20. System 10 further includes a second tank 22 of water 24 for mixing with the flavor concentrate.

A venturi device 26 is constructed and arranged to receive and meter concentrated liquid flavor and water from the first and second tanks 12, 22, respectively. Venturi device 26 includes an outlet port 28 for discharging the metered and mixed flavor and water.

A first line 30 is connected between the first tank 12 of concentrated liquid flavor and a suction port 32 on the venturi device 26. First line 30 includes a pump 34 and a metering valve 36. Similarly, system 10 includes a second line 38 connected between the second tank 22 and an intake port 40 on the venturi device 26. Line 38 includes a pump 42 and a metering valve 44.

A spray manifold 46 with a plurality of spray heads 48 connected hereto is positioned downstream from the discharge outlet 28 of the venturi device 26. A discharge line 50 extends between the discharge outlet 28 and spray manifold 46. Discharge line 50 may include a static mixer 52 and a metering valve 54. A tobacco transport 56 is arranged to transport cut tobacco 58 directly under the spray heads 48 where mixed flavor and water are deposited upon the traveling cut tobacco. The tobacco transport may be a belt conveyor or a rotary cylinder.

In operation, the overall dimensions of the venturi device, particularly the internal geometry thereof, is selected so that a desired amount of liquid concentrated flavor is mixed with a given quantity of water 24. Suitable venturi devices are available from Elmridge, Inc. in Livonia, Mich. Additionally, metering valves 36, 44 may be adjusted to supply proper amounts to the venturi device 26.

The present invention also includes a method of applying liquid flavor to cut tobacco including the steps of supplying concentrated liquid flavor to the suction port 32 of the venturi device 26. Water 24 is delivered to the intake port 40 of the venturi device 26. Mixed flavor and water are discharged from the outlet port 28 of the venturi device 26, and the mixed flavor and water is sprayed onto the cut tobacco 58 as the tobacco is continuously transported past the spray heads 48.

Although a single embodiment of the tobacco flavor applicator has been shown and described, the invention is not limited to such described embodiment and may encompass other arrangements within the scope of the attached claims. The embodiment shown and described has been presented for purposes of illustration and not of limitation.

We claim:

1. A system of applying a mixture of liquid flavor and water to cut tobacco comprising:

a first tank of concentrated liquid flavor;

a second tank of water;

a venturi device constructed and arranged to receive and meter concentrated liquid flavor and water from the first and second tanks and to discharge mixed flavor and water from an outlet end;

a first line connected between the first tank of concentrated liquid flavor and a suction port on the venturi device;

a second line connected between the second tank of water and an intake port on the venturi device;

a stationary spray assembly in fluid communication with the discharge outlet end of the venturi device for applying mixed flavor and water to cut tobacco; and a tobacco transport with cut tobacco thereon directly below the spray assembly whereby the cut tobacco on the transport is sprayed with mixed flavor and water as the cut tobacco travels underneath the spray assembly.

2. A system as in claim 1 wherein the stationary spray assembly includes a spray manifold with a plurality of spaced apart spray heads connected thereto.

3. A system as in claim 1 including:

a first pump and first metering valve in the first line interconnecting the first tank of concentrated liquid flavor with the venturi device; and a second pump and second metering valve in the second line interconnecting the second tank of water with the venturi device.

* * * * *

UNITED STATES PATENT AND TRADEMARK OFFICE

CERTIFICATE OF CORRECTION

PATENT NO. : 8,353,299 B2
APPLICATION NO. : 11/344984
DATED : January 15, 2013
INVENTOR(S) : James L. Sherron et al.

It is certified that error appears in the above-identified patent and that said Letters Patent is hereby corrected as shown below:

In the Claims:

At column 4, claim number 3, line number 13, "A system as in claim 1 including:" should read -- A system as in claim 2 including: --.

Signed and Sealed this
Nineteenth Day of February, 2013

Teresa Stanek Rea
*Acting Director of the United States Patent and Trademark Office*